US005671683A

United States Patent [19]

Parussatti et al.

[11] Patent Number: 5,671,683

[45] Date of Patent: Sep. 30, 1997

[54] RAILWAY VEHICLE WITH VARIABLE TRIM BODY

[75] Inventors: Bruno Parussatti, Candiolo; Mauro Piombo, Savona, both of Italy

[73] Assignee: Fiat Ferroviaria S.p.A., Turin, Italy

[21] Appl. No.: 611,846

[22] Filed: Mar. 8, 1996

[30] Foreign Application Priority Data

Sep. 22, 1995 [IT] Italy ..... TO95A0752

[51] Int. Cl.[6] ..... B61F 3/00

[52] U.S. Cl. ..... 105/199.2

[58] Field of Search ..... 105/199.1, 199.2

[56] References Cited

U.S. PATENT DOCUMENTS 2,874,647 2/1959 Candlin ..... 105/199.2
3,628,465 12/1971 Dobson ..... 105/199.1
3,795,201 3/1974 Tack ..... 105/199.2
3,906,869 9/1975 Dobson et al. ..... 105/199.2
4,526,109 7/1985 Dickhart ..... 105/199.1
5,454,329 10/1995 Liprandi et al. ..... 105/199.2

*Primary Examiner*—Mark T. Le
*Attorney, Agent, or Firm*—Sughrue, Mion, Zinn, Macpeak, and Seas

[57] ABSTRACT

A railway vehicle having a variable trim body, comprising two bogies with respective frameworks and swinging transverse members, articulated connection levers between each swinging transverse member and the body, and a body roll control system to perform, while the vehicle is running along a curve, rotations of the body around a longitudinal axis so as to limit the non-compensated centrifugal acceleration acting on the body. The control system employs linear double-effect actuators acting on the articulated connection levers, whereby the body rotations are operated by virtue of the rotations of these levers.

5 Claims, 2 Drawing Sheets

RAILWAY VEHICLE WITH VARIABLE TRIM BODY

BACKGROUND OF THE INVENTION

The present invention is related to railway vehicles having a variable trim body, of the type comprising two bogies with respective frameworks and swinging transverse members, resilient suspension means between the frameworks of the bogies and the respective swinging transverse members, articulated connection levers between each swinging transverse member and the body, and a body roll control system including actuator means operable to perform, while the vehicle is running along a curve, rotations of the body about a longitudinal axis tending to limit the non-compensated centrifugal acceleration acting on the vehicle body.

The rotation or roll of the body carried out by the control system of the vehicle allows, particularly as far as high-speed railway vehicles are concerned, to appreciably enhance comfort for the passengers, due to the fact that the transverse acceleration felt within the body as the vehicle is running over a curved track is relatively limited.

U.S. Pat. No. 3,844,225 assigned to Fiat Spa discloses a body roll control system for a railway vehicle of the above-referenced type, wherein the actuator means operating the body rotations around the longitudinal axis comprise, for each bogie, a pair of electrical or hydraulic servo-mechanisms substantially vertically interposed between the swinging transverse member and the opposite sides of the body.

Similar arrangements, also employing single-effect hydraulic actuators, are disclosed and illustrated in European patent applications No. 95830392.7 (corresponding to Italian patent application No. TO95A000274) and No. 95830387.7 (corresponding to Italian patent application No. TO95A000275), both unpublished at the priority date of the present application and both in the name of the same Applicant.

According to these solutions, the articulated connection levers between each swinging transverse member and the body solely perform the task of joining the bogies and the body therebetween, so as to allow angular motions operated by the respective actuators to the body around the longitudinal axis. The substantially vertical arrangement of these actuators with the respective attachment members to the swinging transverse members and to the body of the vehicle generally involve both problems of encumbrance, and complications of constructive nature.

SUMMARY OF THE INVENTION

The object of the present invention is thus to overcome the above drawbacks, and more particularly to provide a railway vehicle of the type set forth at the beginning, whose body roll control system has on one hand a reduced encumbrance arrangement and a relatively simple construction, and on the other hand enables to linearize as much as possible the forces required for the actuator means, so as to make the stresses, in both tilting directions of the body about the longitudinal axis, symmetrical.

According to the invention, this object is achieved essentially by virtue of the fact that, in a railway vehicle with variable trim body of the above-referenced type, said actuator means act on the articulated connection levers, whereby the rotations of the body about the longitudinal axis are operated by virtue of rotations of said levers.

According to a preferred embodiment of the invention, said actuator means comprise, for each bogie, a single double-effect linear actuator interposed, transversely to said longitudinal axis, between a pair of corresponding articulated connection levers, and these levers are provided with respective control arms which are fixed in rotation therewith and to which the opposite ends of said double-effect linear actuator are pivotally connected.

The arrangement of these control arms is conveniently such that the double-effect linear actuator is positioned obliquely.

In this case a first lever of said pair of levers has the respective control arm oriented upwardly at an obtuse angle relative to this first lever and having a shorter length, and the second lever of said pair of levers has the respective control arm oriented downwardly at an acute angle relative to this second lever and having a greater length.

Preferably, but not necessarily, the double-effect linear actuators are of electrical type.

BRIEF DESCRIPTION OF THE DRAWINGS

The invention will now be disclosed in detail with reference to the accompanying drawings, purely provided by way of non-limiting example, in which.

DETAILED DESCRIPTION OF THE INVENTION

Figure 1:
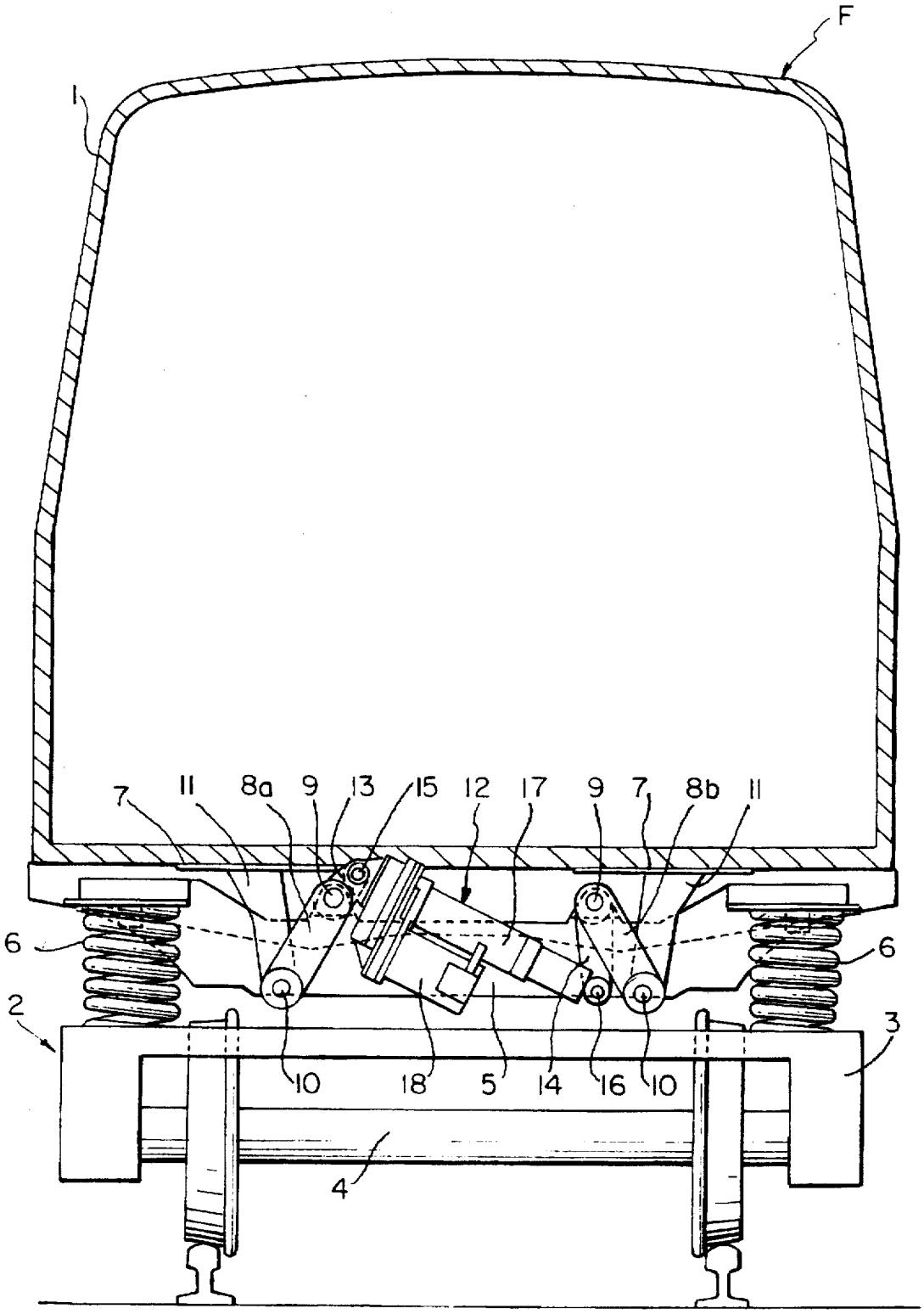
FIG. 1 is a diagrammatic and simplified partially vertical cross sectioned view of a railway vehicle with variable trim body according to the invention, in correspondence of one of the bogies thereof, in the non-tilted configuration of the body.

Referring initially to FIG. 1, a railway vehicle F essentially comprises a body 1 supported in proximity of its opposite ends by two bogies 2 (only one of which being shown in the drawing), each comprising in a way known per sea framework 3, two wheel-and-axle sets 4 and a swinging transverse member 5. The transverse member 5 is mounted onto the respective bogie 2 substantially in correspondence of the transverse center-line thereof, with the interposition of vertical helical springs 6 which constitute the vertical and lateral secondary suspension of the vehicle.

The body 1 of the vehicle F is connected, also in a way known per se, onto the swinging transverse members 5. Connection between each swinging transverse member 5 and a respective transverse load bearing beam diagrammatically shown as 7, which is rigidly fixed under the floor of the body 1, is carried out also in a generally conventional way, through a pair of articulated connection levers or swing hangers 8*a*, 8*b*. Each lever 8*a*, 8*b* is articulated at an upper end at 9 to the swinging transverse member 5, and at a lower end at 10 to a respective appendage 11 rigidly fixed to the load bearing beam 7. The articulation axes 9 and 10 are normally oriented substantially parallel to the longitudinal axis of the vehicle F.

It is to be pointed out that the illustration of FIG. 1 is to be purely considered as a functional scheme of principle, without a precise correspondence with the actual structural construction of the shown components. Actually, the constructive arrangement of the vehicle F provides, for each of the two swinging transverse members 5 associated to the respective bogies 2, pairs of articulated connection levers 8*a*, 8*b*, i.e. respectively a left pair and a right pair with reference to the drawing, with the two levers of each left and right pair situated respectively one in the front and the other behind the swinging transverse member 5. The two levers 8*a*, 8*b* of each right and left pair are rigidly coupled in rotation to each other, in a way not shown in detail but readily within the skill of the expert in the art, through respective shafts or studs corresponding to the articulation axis 9 and 10.

The vehicle F is equipped with a control system of the body 1 rotation relative to the bogies 2, in opposite directions about a longitudinal axis of the vehicle F, so as to vary trim of the body 1 while the vehicle F is running along a curve to the aim of limiting the non-compensated centrifugal acceleration acting on the body 1 in such conditions.

The control system for controlling rotation or roll of the body 1 comprises, in a way generally known (for instance from the prior patent documents mentioned in the above), a servo-mechanism piloted by a regulation electronic unit in turn operatively connected to transducer devices adapted to detect the non-compensated acceleration acting on the body 1 and the condition of travel along a curve of the vehicle F. The servo-mechanism includes linear actuators arranged in correspondence of the bogies 2 and associated power generators, controlled by the regulation electronic unit.

In accordance with the fundamental feature of the invention, said servo-mechanism acts on the articulated connection levers 8*a*, 8*b* corresponding to the swinging transverse member 5 of each bogie 2, in such a way that the rotations of the body 1 about the longitudinal axis are operated through rotations of these levers 8*a*, 8*b*.

More in detail, the arrangement according to the invention contemplates, for each bogie 2, a single double-effect linear actuator 12 interposed transversely to the longitudinal axis of the vehicle F between a corresponding pair of right and left, respectively, levers 8*a*, 8*b*.

The following description, which is referred to the bogie 2 depicted in FIG. 1, is to be identically applied also to the other bogie. Specifically, to one and to the other left and right, respectively, lever 8*a*, 8*b* a respective extension or control arm is associated and fixed in rotation therewith, for the articulated connection of the double-effect linear actuator 12.

As far as the left lever 8*a* is concerned, the corresponding control arm is indicated as 13 and is oriented upwardly at an obtuse angle relative to this lever 8*a*. As far as the right lever 8*b* is concerned, the respective control arm is indicated as 14 and is oriented downwardly at an acute angle relative to this lever 8*b*. The arm 13 associated to the lever 8*a* has a length which is shorter than the length of the arm 14 associated to the lever 8*b*.

The free ends of the arms 13 and 14 carry respective pins 15, 16, which are parallel to the axis 9 and 10, for the articulated connection of the double-effect linear actuator 12.

With the above-disclosed arrangement, the double-effect linear actuator 12 is positioned obliquely beneath the body 1.

This actuator 12 is preferably, but not necessarily, of electrical type, and includes in a conventional way an axially extendable and retractable structure 17, for instance of the screw and nut type, operated by an electrical motor 18 which is supplied by an electrical power source under control of the regulation electronic unit of the body 1 rotation control system.

In operation, when the vehicle F is travelling along a straight track the double-effect linear actuator 12 associated to each bogie 2 is maintained in the configuration depicted in FIG. 1, intermediate between a maximum and a minimum extension condition. Consequently, the body 1 is placed in the non-tilted configuration also shown in FIG. 1, and the articulated connection levers 8*a*, 8*b* are arranged according to the orientation illustrated in the same figure, i.e. with opposite and upwardly converging inclinations.

Figure 2:
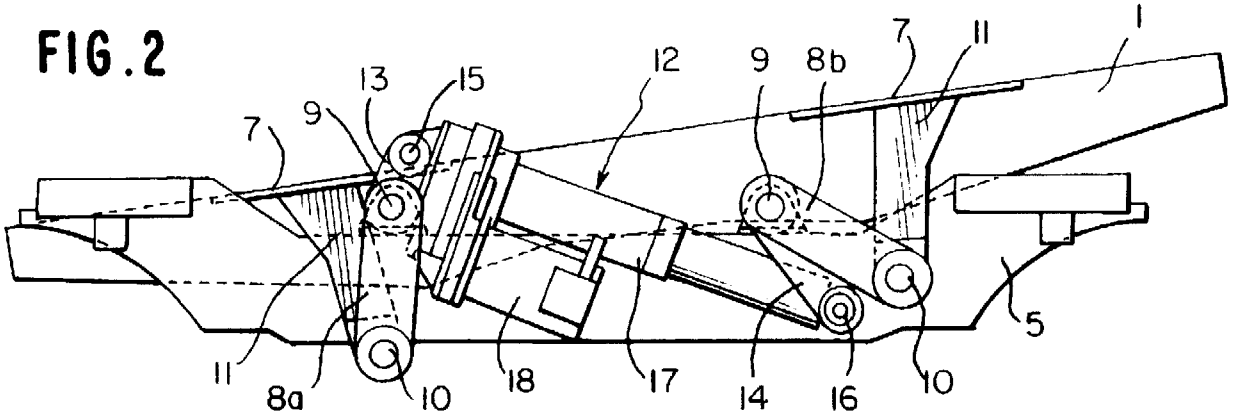
FIGS. 2 and 3 are two fragmentary and enlarged views of part of FIG. 1 in the configuration of maximum tilting of the body in one direction and in the opposite direction, respectively.
Figure 3:
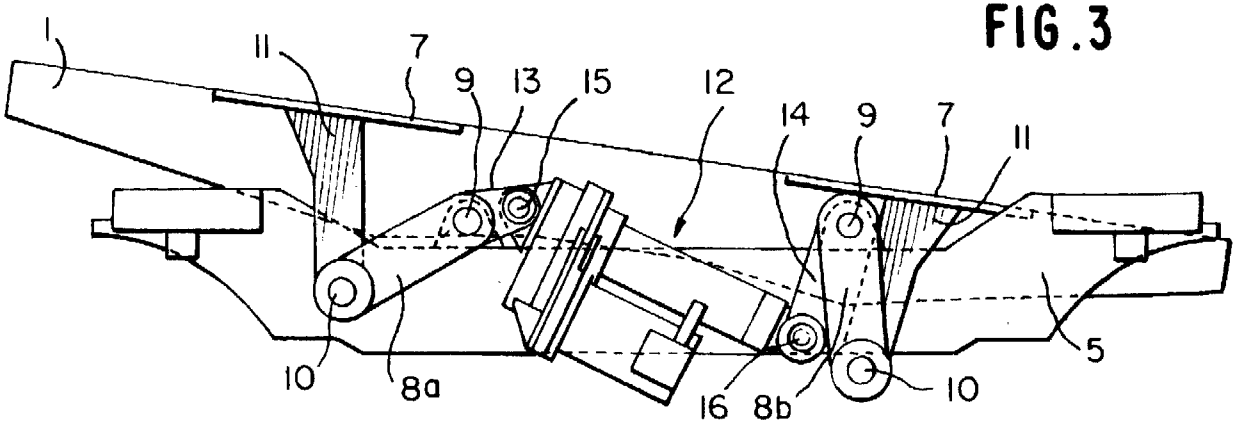

When the sensors associated to the regulation electronic unit of the body 1 tilt control system detect the travel condition of the vehicle F along a curve, intervention of the double-effect linear actuators 12 is piloted, which perform rotation of the body 1 towards the inside of the curve, so as to reduce the transverse acceleration felt by the passenger within the body. FIGS. 2 and 3 show the configuration of the actuator 12 and of the control arms 13, 14 of the respective articulated connection levers 8*a*, 8*b* corresponding to the maximum rotation of the body 1 about the longitudinal axis in anti-clockwise and clockwise direction, respectively. In the first case (FIG. 2) the double-effect linear actuators 12 are completely extended, i.e. in the maximum elongation condition, while in the second case (FIG. 3) these actuators 12 are completely retracted, i.e. in the minimum elongation configuration. By way of example, the maximum angular range imparted to the body 1 in the above two configurations may be of ±8°, with a total linear extension of the actuators 12 of about 30 cm.

By virtue of the above disclosed construction of the invention, and particularly of the peculiar feature according to which the actuators 12 act on the articulated connection levers 8*a*, 8*b*, when the body 1 is rotated about the longitudinal axis couples are applied, instead of forces as in the prior art, between the body itself and the bogies 2, with the advantage of remarkably reducing the structural stresses. Moreover the strains of the actuators 12 required for operating rotation of the body 1 are as far as possible linearized and made symmetrical in the two tilting directions of the body 1. Further, employing a single double-effect linear actuator 12 arranged transversely in correspondence of each bogie 2, enables a reduction of encumbrance and leads to a simplified construction of the vehicle.

Naturally the details of construction and the embodiments may be widely varied with respect to what has been disclosed and illustrated, without departing from the scope of the present invention, such as defined in the appended claims. In particular, as already previously clarified, while the embodiment disclosed and illustrated employs double-effect linear actuators 12 of electrical type, the invention is equally applicable to control systems provided with actuators of a different type, for instance fluid pressure actuators.

What is claimed is:

1. A railway vehicle comprising a variable trim body having a longitudinal axis, two bogies having respective frameworks and swinging transverse members, articulated connection levers between each of said swinging transverse members and said body, and a body roll control system including actuator means operable to perform, while the vehicle is running along a curve, rotations of said body about said longitudinal axis tending to limit non-compensated centrifugal acceleration acting on said body, wherein said actuator means direct act on said articulated connection levers, whereby said body rotations are operated by virtue of rotations of said levers.

2. A railway vehicle according to claim 1, wherein said actuator means comprise, for each bogie, a single double-effect linear actuator having respective opposite ends and interposed, transversely to said longitudinal axis, between a pair of corresponding ones of said articulated connection levers, wherein said levers are provided with respective control arms fixed in rotation with said levers and wherein said opposite ends of said double-effect linear actuator are pivotally connected to said respective control arms.

3. A railway vehicle according to claim 2, wherein said control arms are arranged so that said double-effect linear actuator is positioned obliquely.

4. A railway vehicle according to claim 3, wherein a first lever of said pair of levers has the respective control arm oriented upwardly at an obtuse angle relative to said first lever and a second lever of said pair of levers has the respective control arm oriented downwardly at an acute angle relative to said second lever, and wherein the control arm of the first lever has a shorter length than the control arm of the second lever.

5. A railway vehicle according to claim 2, wherein said double-effect linear actuator is an electrical actuator.

* * * * *